United States Patent [19]

Shishkin et al.

[11] Patent Number: 4,828,796

[45] Date of Patent: May 9, 1989

[54] METHOD OF PROTECTING THE INTERNAL SURFACE OF A PIPELINE AGAINST CORROSION

[75] Inventors: Viktor V. Shishkin, Krasnodar; Yaroslav P. Sushkov, Eisk; Duglas Z. Serazetdinov, Alma-Ata; Evgeny G. Lukin, Alma-Ata; Viktoria I. Kapralova, Alma-Ata; Tamara S. Polyanskaya, Alma-Ata; Ljubov I. Abramova, Alma-Ata; Jury P. Shapovalov, Krasnodar; Viktor N. Oleinik, Moscow; Nikolai F. Kryazhevskikh, Krasnodar; Alexandr I. Chernyai, Alma-Ata, all of U.S.S.R.

[73] Assignees: Inzhenerny, Tsentr, Po, Selskokhozyaistvenno Vodosnabheniju, I, Truboprovodam, Krasnodar; Alma-atinsky, Institut, Inzhenero, Zheleznodorozhnogo Transporta; Institut Khimicheskikh, Nauk, Akademii, Nauk, Kazakhskoi, both of Alma-Ata, all of U.S.S.R.

[21] Appl. No.: 882,887

[22] PCT Filed: Oct. 16, 1985

[86] PCT No.: PCT/SU85/00089

§ 371 Date: Jun. 9, 1986

§ 102(e) Date: Jun. 9, 1986

[87] PCT Pub. No.: WO86/02426

PCT Pub. Date: Apr. 24, 1986

[30] Foreign Application Priority Data

| | | | |
|---|---|---|---|
| Oct. 17, 1984 | [SU] | U.S.S.R. | 3798002 |
| Oct. 17, 1984 | [SU] | U.S.S.R. | 3798012 |
| Oct. 17, 1984 | [SU] | U.S.S.R. | 3798009 |
| Oct. 17, 1984 | [SU] | U.S.S.R. | 3797906 |
| Oct. 17, 1984 | [SU] | U.S.S.R. | 3798005 |
| Oct. 17, 1984 | [SU] | U.S.S.R. | 3797903 |
| Oct. 17, 1984 | [SU] | U.S.S.R. | 3798052 |

[51] Int. Cl.[4] ..... C23F 11/167

[52] U.S. Cl. ..... 422/18; 422/19; 252/389.23; 106/14.12;

[58] Field of Search ..... 422/8, 18, 19; 427/239, 427/12, 331; 204/86, 90; 252/389.23; 106/14.12; 148/6.15 R; 210/697

[56] References Cited

U.S. PATENT DOCUMENTS

| | | | |
|---|---|---|---|
| 3,960,576 | 6/1976 | Carter et al. | 422/18 |
| 3,973,056 | 8/1976 | Fessler et al. | 427/136 |
| 3,974,047 | 8/1976 | Ramp | 204/90 |
| 4,085,063 | 4/1978 | Liu | 422/18 |
| 4,405,493 | 9/1983 | Pippard | 422/8 |
| 4,431,563 | 2/1984 | Krawczyk et al. | 422/19 |
| 4,454,172 | 6/1984 | Heinrich et al. | 427/239 |

FOREIGN PATENT DOCUMENTS

| | | | |
|---|---|---|---|
| 9080 | 4/1980 | European Pat. Off. | 422/18 |
| 3232615 | 3/1984 | Fed. Rep. of Germany | 422/18 |
| 2011236 | 2/1970 | France | 106/14.12 |
| 60-593 | 9/1985 | Japan . | |

OTHER PUBLICATIONS

Akolzin et al., Oxygen Corrosion of Chemical Industry Equipment, Khimia, Moscow, 1985, pp. 162–166 (with trans.).

Akolzin et al., Oxygen Corrosion of Industrial Chemical Equipment, Khimia, Moscow, 1985, pp. 146–149 (with trans.).

Kliachko et al., Purification of Natural Wastes, Moscow, 1971; pp. 506–512 (with trans.).

*Primary Examiner*—Benoit Castel

*Attorney, Agent, or Firm*—Lilling & Greenspan

[57] ABSTRACT

A method of protecting the internal surface of a pipeline against corrosion resides in introducing into the pipeline a composition comprising 0.01 to 1 part of a phosphate and a silicate. The phosphate can be sodium polyphosphate or monosubstituted potassium phosphate. The silicate can be an alkaline metal silicate or silicon dioxide. The weight ratio of the phosphate to the silicate varies from 9–50:1, respectively, and the composition includes up to 100 parts of water. The composition is formed by fusing the phosphate and the silicate at a temperature of about 800 to 10000 degrees C. and cooling the fused composition until a vitreous structure is formed. The composition is then introduced into a pipeline containing water having a $P_2O_5$ concentration of about 0.3 to 3.5 milligrams per liter.

7 Claims, No Drawings

METHOD OF PROTECTING THE INTERNAL SURFACE OF A PIPELINE AGAINST CORROSION

FIELD OF THE INVENTION

The present invention relates to the maintenance of trunk and branched networks of pressure and free-flow steel pipelines, and more particularly, to a compound for protecting the internal surface of a pipeline against corrosion, a method of producing same and a method of protecting the internal surface of a pipeline against corrosion using this compound.

PRIOR ART

Today there are known in the art various compounds for protecting the internal surface of pipelines against corrosion, e.g., silicates of alkaline metals creating a coating of iron ferrosilicates on the surface. At the same time, use is made of silicates, namely, sodium, metasilicate, sodium disilicate and sodium trisilicate (cf. A. O. Akolzin "Oxygen Corrosion of Equipment in Chemical Industry", Khimia Publishers, 1985, Moscow, pp. 162–167).

The application of the afore-mentioned compounds for protecting the internal surface of a pipeline against corrosion calls for the use of high concentrations thereof which makes them unsuitable in protecting drinking water supply lines.

Known in the art is a pipeline corrosion-preventive compound based on phosphates, e.g., sodium hexametaphosphate, trisodium phosphate and superphosphate (A. P. Akolzin. "Oxygen Corrosion of Equipment in Chemical Industry", Khimia Publishers, 1985, Moscow, p. 146–149).

The application of the above-mentioned compounds in the concentration below 3.5 mg/l in terms of $P_2O_5$ may enhance the corrosion of pipelines, therefore, they are unsuitable for protecting the drinking water supply lines.

Known in the art is a pipeline crorrosion-preventive compound comprising the mixture of polyphosphate and sodium silicate.

The method of producing the afore-mentioned compound consists in dissolving sodium silicate and sodium polyphosphate in parallel, whereupon two solutions are mixed and diluted with water (V. A. Klyachko, I. E. Apeltsin "Cleaning of Natural Waters", Stroiizdat Publishers, 1971, Moscow, pp. 507–512).

A disadvantage of the above method is a complex process of dissolving sodium silicate which is very slowly dissolved in cold water (the dissolution process lasts dozens of days). A sophisticated equipment is required for dissolving sodium silicate (autoclaves with pressurized steam supply).

Besides, the said compound fails to ensure a reliable corrosion-preventive coating of the pipeline internal surface with a long period of aftereffect.

Known in the art is a method of protecting the pipeline internal surface against corrosion using a compound, e.g., sodium polyphosphate.

The method resides in removing deposits from the clean surface of the pipeline and is treated for 6 days with a solution of sodium polyphosphate with the concentration of 75 mg/l in terms of $P_2O_5$, whereupon, the protective coating formed is constantly replenished with a diluted solution of sodium polyphosphate (5 mg/l in terms of $P_2O_5$) (V. A. Klyachko, I. E. Apeltsin "Cleaning of Natural Waters", Stroiizdat Publishers, Moscow, 1971, pp. 507–512).

This method is characterized by the fact that it is necessary to constantly maintain a definite relation of calcium and sodium polyphosphates in the pipeline, because sodium polyphosphates may give rise to corrosion. A constant replenishment with a diluted solution of sodium polyphosphate of said concentration makes it impossible to use said method for preventing corrosion in drinking water supply pipelines. Besides, this method cannot provide a protective coating with a long period of aftereffect on the pipeline internal surface.

SUMMARY OF THE INVENTION

It is the main object of the present invention to provide a corrosion-preventive compound for the pipeline internal surface, making it possible to develop a protective coating possessing strength and a long period of aftereffect and capable of being used for protecting drinking water supply pipelines against corrosion.

The main object is attained due to the fact that the compound as claimed for protecting the internal surface of the pipeline against corrosion, comprising sodium polyphosphate and sodium silicate, according to the invention consists of an alloy of sodium polyphosphate or monosubstituted potassium phosphate with a silicate of alkaline metal or silicon dioxide taken in the weight ratios of 9–50:1, respectively.

It is preferable that said compound contain water with the following relation of starting components in parts by weight:

an alloy of sodium polyphosphate or monosubstituted potassium phosphate with silicate of alkaline metal or silicon dioxide: 0.01–1.0 water: up to 100.

This makes it possible to protect pipelines against corrosion during preservation, as well as facilitates the protection of operating pipelines.

The herein disclosed compound for protecting the internal surface of a pipeline against corrosion, according to the invention, is produced by mixing sodium polyphosphate or monosubstituted potassium phosphate with the silicate of alkaline metal or silicon dioxide in the weight ratio of 9–50:1, respectively, fusing together the mixture obtained at a temperature of from 800° to 1000° C. with a subsequent cooling of the alloy prepared until a vitreous structure is formed and an end product is produced.

The afore-mentioned method enables one to produce a water-soluble alloy (soluble at a temperature of 5° to 20°C.) which makes it possible to use it in water supply systems without preliminary treatment.

It is expedient that the obtained alloy of a vitreous structure be treated with an electron beam having an energy of $10^3$–$10^5$ kW/cm$^2$ which improves the quality of the disclosed compound and decreases the corrosion rate four times.

The end product may be obtained by dissolving the alloy of a vitreous structure in water with a subsequent electrolysis of the solution formed or treatment thereof with an electrohydraulic shock. This enables one to decrease the rate of corrosion and reduce the consumption of the compound by 100 percent.

What is also claimed is the method of protecting the pipeline internal surface using the herein disclosed compound, which resides in that the said compound with the concentration of 0.3 to 3.5 mg/l in terms of $P_2O_5$ is introduced in the operating water supply pipeline. It is preferable that the afore-listed compound be introduced with the concentration of 0.3 to 0.6 mg/l in terms of $P_2O_5$.

The compound as claimed may be pressed in the internal surface of the pipeline which decreases the corrosion rate and prolongs the aftereffect life of the protective coating.

It is expedient that the herein disclosed compound be introduced in water, which moves along the pipeline internal surface, in the form of a layer adjacent to said surface. This helps decrease the corrosion rate and prolongs the aftereffect life of the protective coating.

To increase the aftereffect life of the protective coating the afore-mentioned compound is introduced in water obtained during electrolysis from a positive electrode. It is preferable that an aluminum alloy of the following composition in wt. % be applied on the water pipeline internal surface prior to or alongside the introduction of the said compound in the pipeline:

magnesium: 0.1–1.0
gallium: 0.1–3.5
aluminum: the remainder

The compound as claimed may be used for protecting sea water supply pipelines against corrosion. This compound with a concentration of 25–250 mg/l in terms of phosphorus is introduced in the operating sea water pipeline.

BEST MODE FOR CARRYING OUT THE INVENTION

The herein disclosed compound for protecting the pipeline internal surface against corrosion is an alloy of sodium polyphosphate or monosubstituted potassium phosphate with the silicate of alkaline metal or silicon dioxide taken in the weight ratio of 9–50:1, respectively. This compound may be used both dry and in the form of aqueous solutions. The method of producing the compound as claimed residues in mixing sodium polyphosphate or monosubstituted potassium phosphate with the silicate of alkaline metal or silicon dioxide in the weight ratio of 9–50:1, respectively, the mixture obtained is fused at a temperature of 800° to 1000° C. The alloy is cooled until a vitreous structure is formed. It is desirable that the resultant alloy of a vitreous structure be treated with an electron beam having an energy of $10^3$–$10^5$ kW/cm$^2$.

The use of the compound as claimed enables one to slow down the corrosion rate four times.

The obtained alloy of a vitreous structure may be dissolved in water with a subsequent electrolysis of the obtained solution or treatment thereof with an electrohydraulic shock. As the solution is electrolyzed, the disclosed compound being used reduces the corrosion rate by 100 percent and decreases its consumption also by 100 percent. As the solution in question is treated with an electrohydraulic shock, the disclosed compound slows down the corrosion rate by 15 percent.

The method of protecting the pipeline internal surface against corrosion using the compound as claimed resides in that the latter is introduced in the operating water supply pipeline in the concentration of 0.3–3.5 mg/l in terms of $P_2O_5$, preferably, in the concentration of 0.3–0.6 mg/l in terms of $P_2O_5$. It is expedient that the disclosed compound be pressed in the pipeline internal surface, e.g., by means of an electrohydraulic shock or a hydrodynamic attack of a jet. This makes it possible to increase 15 times the aftereffect life of the protective coating obtained. It is also possible to introduce the compound as claimed in water moving along the internal surface of the pipeline in the form of a layer adjacent to this surface. This may be done, e.g., by dividing the flow through the introduction of an additional pipe in the pipeline. It is advisable that the disclosed compound be introduced in the water obtained during the electrolysis from a positive electrode. This enables one to slow down the corrosion rate 20 times and increase the aftereffect life by 30 percent.

It is preferable that an aluminum alloy of the following composition in wt. % be applied on the pipeline internal surface prior or alongside the introduction of the disclosed compound.

magnesium: 0.1–1.0
gallium: 0.1–3.5
aluminum: the rest

This is conducive to increasing the aftereffect life of the obtained protective coating 2.6 times. The compound as claimed helps protect the internal surface of a sea water supply pipeline against corrosion, said compound being introduced in the pipeline with a concentration of 25–250 mg/l in terms of phosphorus.

The disclosed compound ensures a firm protective coating possessing a long aftereffect life up to 570 days.

The compound as claimed makes it possible to protect drinking water supply lines with a concentration which does not exceed 3.5 mg/l in terms of $P_2O_5$.

The present invention will be more apparent upon considering specific exemplary embodiments of the corrosion-preventive compound, the method for producing same and the method of protecting the pipeline internal surface against corrosion using this compound.

EXAMPLE 1

A compound for protecting the pipeline internal surface against corrosion comprises the following components, parts by weight:

an alloy of sodium polyphosphate with sodium silicate taken in the weight ratio 25:1, respectively: 0.04
water: up to 100

The herein disclosed compound is produced as follows:

Sodium polyphosphate is mixed with sodium silicate in the ratio of 25:1, whereupon the mixture is heated to 1000° C. until it is fully dissolved. Then, the mixture is quickly cooled to a temperature of 20° C. for 5 minutes, being spilled out onto a copper sheet in a thin layer (1 mm).

Thereafter, the alloy is dissolved in water with the following ratios in parts by weight:

alloy obtained: 0.04
water: 100

The produced compound was introduced in a steel pipeline during 18 months, whereupon drinking water was supplied along the pipeline over 36 months. Thereafter, samples were cut out of the pipeline wall and were tested for corrosion. A corrosion-preventive film of grey colour was observed on the pipeline internal surface.

EXAMPLE 2

A compound for protecting the pipeline internal surface against corrosion comprises an alloy of monosubstituted potassium phosphate with silicon dioxide taken in a ratio of 10:1, respectively. Said alloys are obtained by mixing monosubstituted potassium phosphate with silicon dioxide in the afore-mentioned ratios. The resultant mixture is melted at a temperature of 800° C., whereupon the melt is quickly (for 5 to 10 min) cooled to a temperature of 20–40° C. so that it acquires a vitreous shape. The compounds obtained are tested for corrosion. For this purpose, these compounds are dissolved in water. 50×30×2 mm samples of hydrocarbon steel are submerged into open 200 ml beakers filled with resultant solutions. The latter are changed every day. The corrosion rate is determined colorimetrically. The duration of tests is 25 days.

Test data are given in Table 1

TABLE 1

Relationship Between Steel Corrosion Rate and the Use of the Disclosed Compound

| No. 1 | Solution composition 2 | Concentration mg/l 3 | Silicon dioxide-acidic potassium phosphate ratio 4 | Phosphate hydrolysis degree, % 5 | Corrosion rate, mg/cm² per day 6 |
|---|---|---|---|---|---|
| | Prior Art Compositions | | | | |
| 1. | Water | — | — | — | 0.10 |
| 2. | Aqueous solution of sodium silicate | 50<br>10 | —<br>— | —<br>— | 0.08<br>0.09 |
| 3. | Aqueous solution of the mixture of sodium silicate taken in the ratio 10:1, respectively | 50<br>5 | —<br>— | 15–20<br>— | 0.07<br>0.09 |
| | Herein Disclosed Compounds | | | | |
| 4. | Alloy of acidic potassium phosphate with silicon dioxide | 50<br>5 | $SiO_2$ 2%<br>$KH_2PO_4$ - the rest | 35 | 0.010 |
| 5. | Alloy of acidic potassium phosphate with silicon dioxide | 50<br>5 | $SiO_2$ 8%<br>$KH_2PO_4$ - the rest | 38 | 0.020<br>0.050 |
| 6. | Alloy of acidic potassium phosphate with silicon dioxide | 50<br>5 | $SiO_2$ 10%<br>$KH_2PO_4$ - the rest | 40 | 0.010<br>0.055 |

The application of the disclosed compounds creates a very thin tight coating of ash-gray with iridescence colour on steel as distinct from the samples of prior art compositions being in water. When using the prior art compositions the samples are coated with a layer of oxides of light-brown colour. The effectiveness of protection provided by this coating is several times lower than when treating with the disclosed compound.

EXAMPLE 3

A compound is prepared with the composition analogous to that outlined in Example 2. Acidic potassium phosphate is melted at a temperature of 1100° C. adding silicon dioxide thereto. The mixture is pumped over and is quickly spilled out onto a metal sheet at a temperature of 20° C.

The coating thickness on the sheet is 1 to 2 mm.

Once the alloy is cooled, it is dissolved.

Solutions of synthetic sea water are prepared adding the solutions obtained thereto with the concentration of 25 to 250 mg/l in terms of phosphorus.

The synthetic sea water solutions (total concentration of 7 g/l) having additives of the disclosed compounds are poured into open 200 mm beakers and steel samples of 50×30×2 mm in size are submerged thereinto. One can judge about the corrosion resistance by the amount of oxidized iron which went over to water over the time, which is determined colorimetrically, as well as by the difference between the weights of the samples prior to the beginning of and upon the completion of tests. Duration of tests is 30 days.

Experimental data are given in Table 2.

TABLE 2

| No. 1 | Composition 2 | Concentration of disclosed compound in synthetic sea water, mg/l in terms of P 3 | Silicon dioxide - acidic potassium phosphate ratio in disclosed compound 4 | Corrosion rate, mg/cm² per day 5 |
|---|---|---|---|---|
| 1. | Synthetic sea water | — | — | 0.5 |
| 2. | Synthetic sea water + disclosed compound | 25<br>50<br>100<br>150 | $SiO_2$ 2%, $KH_2PO_4$ - the rest | 0.10<br>0.09<br>0.08<br>0.08 |
| 3. | Synthetic sea water + disclosed compound | 25<br>50 | $SiO_2$ 8%, $KH_2PO_4$ - the rest | 0.08<br>0.06 |
| 3. | Synthetic sea water + disclosed compound | 100<br>150 | | 0.05<br>0.05 |
| 4. | Synthetic sea water + disclosed compound | 25<br>50<br>100<br>150 | $SiO_2$ 10% $KH_2PO_4$ - the rest | 0.08<br>0.05<br>0.05<br>0.04 |
| 5. | Synthetic sea water + disclosed compound | 250 | $SiO_2$ 10% $KH_2PO_4$ - the rest | 0.03 |

EXAMPLE 4

A compound is prepared in an analogous manner described in Example 1.

Determined at the test unit with a forced circulation of water in a 10 m long and 100 mm in dia pipe is the steel corrosion (rate (colorimetrically by the transition of iron ions to water) under the conditions:

(a) without treating the water with the disclosed compound;

(b) treating the water with the disclosed compound with a concentration of 1 mg/l in terms of $P_2O_5$;

(c) treating the water with the disclosed compound with a concentration of 1 mg/l in terms of $P_2O_5$ alongside an electrohydraulic shock.

The water is treated alongside an electrohydraulic shock in the following manner.

The compound as claimed is loaded into a solution tank. Water is supplied into the above-mentioned tank. As the disclosed compounds make contact with water, it is dissolved.

As the compound is dissolved, it is affected by an electrohydraulic shock wave which is obtained by a 10 Hz, 18 kV and 30 μF charge to the electrodes. Thereafter, the solution is fed to a test unit pipeline where it is additionally treated with an electrohydraulic shock having the same parameters. The electrohydraulic shock also affects the pipeline wall. Test data are given in Table 3. Duration of tests is 30 days.

TABLE 3

| Dependence of Steel Corrosion Rate ($mg/cm^2$ per day) upon the Type of Treatment | | |
|---|---|---|
| No | Type of treatment | Corrosion rate, $mg/cm^2$ per day |
| 1. | Without treating the water with the compound | 0.110 |
| 2. | Treating the water with the disclosed compound, 1 mg/l in terms of $P_2O_5$ | 0.060 |
| 3. | Treating the water with the disclosed compound, 1 mg/l in terms of $P_2O_5$ alongside an electrohydraulic shock | 0.050 |

EXAMPLE 5

A compound analogous to that outlined in Example 1 is treated with an electron beam having energy of 1 $10^3$ $kW/cm^2$. Thereafter, it is dissolved in water with the concentration of 3.5 mg/l in terms of $P_2O_5$. The solution obtained is pumped for 30 days through a 700 mm dia and 100 m long pipeline at the test unit. Test data are given in Table 4.

TABLE 4

| No. | Type of treatment | Corrosion rate, $mg/cm^2$ per day | Notes |
|---|---|---|---|
| 1. | Without treating water with disclosed compound | 0.1 | Sample surface is covered with a loose thick layer of oxides |
| 2. | Treating with disclosed compound with concentration of 3.5 mg/l in terms of $P_2O_5$ | 0.04 | Even, thin layer of iron oxides |
| 3. | Treating with disclosed compound with concentration of 3.5 mg/l in terms of $P_2O_5$ with preliminary treatment with an electron beam | 0.02 | Even, thin, dense layer of iron oxides |

EXAMPLE 6

A compound analogous to that described in Example 1 is dissolved in water with the concentration of 1 mg/l in terms of $P_2O_5$. The solution obtained is electrolyzed at graphite electrodes by a 2 $A/m^2$ current for 1 to 10 hours. The resultant solution is pumped via a 700 mm dia and 200 km long pipeline. Steel samples are installed in the pipeline; the steel corrosion rate is determined by the change in the weight of said samples. Test results are given in Table 5.

TABLE 5

| No. | Method of treating the sample | Corrosion rate, $mg/cm^2$ per day |
|---|---|---|
| 1. | Without treating water with disclosed compound | 0.1 |
| 2. | Treating with disclosed compound with concentration of 1 mg/l in terms of $P_2O_5$ | 0.07 |
| 3. | Treating with disclosed compound with concentration of 1 mg/l in terms of $P_2O_5$, electrolyzed for 5 hours | 0.05 |
| 4. | The same, for 3 hours | 0.07 |
| 5. | The same, for 1 hour | 0.09 |
| 6. | The same, for 10 hours | 0.05 |

EXAMPLE 7

A 40 km long, 800 mm dia steel pipeline is treated with a compound analogous to that described in Example 1 in order to prevent corrosion.

Drinking water transported along the pipeline contains 550 mg/l salts, has a hardness of 3 mg-eq./l, iron (total)-0.1 mg/l.

The disclosed compound concentration is 0.4 mg/l in terms of $P_2O_5$.

A constant recovery of iron with water in the amount of 0.8 to 1 mg/l is observed at the final section of the pipeline.

After two months from the beginning of treatment with the disclosed compound the content of iron declined to 0.1–0.2 mg/l, i.e., the corrosion rate dropped 8 to 10 times.

Inspection of the line showed the absence of any noticeable growth of the internal surface.

EXAMPLE 8

Carbon steel samples of $100\times100\times2$ mm in size are placed in the chamber of an electrohydraulic machine whose cavity is filled with an aqueous solution of the disclosed compound analogous to that in Example 1, with the concentration of 0.8 mg/l in terms of $P_2O_5$.

A shock wave is formed in the chamber by means of electrohydraulic shocks which affects the samples and presses in the compound as claimed in the surface thereof. The electrohydraulic shock is produced by feeding a 10 Hz, 18 kV and 30 $\mu F$ charge to the electrodes. Thereafter, the samples are tested for corrosion. Test data are given in Table 6. Duration of tests is 10 days.

TABLE 6

| No. | Type of treatment | Corrosion rate, $mg/cm^2$ per day | Aftereffect life, days |
|---|---|---|---|
| 1. | Treating of samples with disclosed compound with concentration of 3.5 mg/l in terms of $P_2O_5$ | 0.06 | 200 |
| 2. | Treating of samples by pressing the disclosed compound in the surface thereof with concentration of 3.5 mg/l in terms of $P_2O_5$ | 0.05 | 580 |

EXAMPLE 9

A polymer tube is installed in a pipeline which forms an annular clearance with the internal surface of this pipeline. Drinking water is supplied along the inner tube, and an aqueous solution of the disclosed compound, analogous to that in Example 1 with the concentration of 3.5 mg/l in terms of $P_2O_5$, is fed along the annular clearance. After 12 months a protective film of a light brown colour is obtained on the pipeline wall, samples are cut out of the pipeline wall and tested for corrosion.

Sample corrosion rate is 0.004 $mg/cm^2$ per day.

EXAMPLE 10

Samples are tested in the manner analogous to that in Example 9, with the exception that the water obtained through electrolysis and pumed from the positive electrode is fed to the annular clearance. Electrolysis is conducted as a 24 V and 300 A current is applied to the electrodes.

The sample corrosion rate is analogous to the corrosion rate of Example 9, but the aftereffect life is prolonged by 30 percent.

EXAMPLE 11

Prior to the introduction of the disclosed compound analogous to that in Example 1 in the pipeline to protect the latter against corrosion a layer of the melt of an aluminum alloy is sprayed on a dry internal surface of the pipeline in an amont of 30 g per 1 $m^2$ of the pipeline surface. The alloy is prepared with the following composition in parts by weight:

gallium: 1
magnesium: 0.5
aluminum: the remainder.

A protective coating is produced on the pipeline wall the aftereffect life of which is increased 2.6 times.

EXAMPLE 12

The tests on protecting carbon steel samples against corrosion are conducted in the manner analogous to that outlined in Example 8. The distinction consists in that a finely-dispersed powder of the aluminum alloy (comprising in parts by weight: gallim—1.0; magnesium—0.5; aluminum—the rest) is pressed in the sample surface alongside the disclosed compound. The amount of the alloy is 5 g per 1 $m^2$ of the surface to be protected. Test results show that the aftereffect life of the protective coating is increased 3.7 times.

EXAMPLE 13

A ring made from the alloy of aluminum, gallium, magnesium is mounted in each of the five electrically grounded testing units of 100 mm in diameter and 10 m in length. This ring is connected to a power source and is moved along the testing unit. As the ring moves, drinking water is fed through the testing unit with the consumption of 40 l/min, the disclosed compound analogous to Example 1 being introduced in said water, with the concentration of 3 mg/l in terms of $P_2O_5$.

The parameters of the ring movement speed and the current applied to said ring are changed. The content of magnesium and gallium in the alloy is changed in each unit. After the tests, the samples are cut out from the unit for assessing the quality of the coating thereon.

The steel corrosion rate in mg/$cm^2$ per day is determined by the kinetic curves of the transition of iron ions into water. Test results are given in Table 7.

TABLE 7

| No. | Content of magnesium, gallium, aluminum, wt. % | Ring movement speed. m/s: 0.001 | 0.002 | 0.005 | 0.01 | 0.025 | 0.03 | Density of current fed to ring A/$m^2$ | Aftereffect life, days |
|---|---|---|---|---|---|---|---|---|---|
| | | Sample corrosion rate, mg/$cm^2$ per day | | | | | | | |
| 1 | 2 | 3 | 4 | 5 | 6 | 7 | 8 | 9 | 10 |
| 1. | Magnesium 0.09 | 0.09 | 0.09 | 0.09 | 0.09 | 0.09 | 0.09 | 2 | 387 |
| | Gallium 0.09 | 0.09 | 0.09 | 0.09 | 0.09 | 0.09 | 0.09 | 4 | |
| | Aluminum- | 0.09 | 0.09 | 0.09 | 0.09 | 0.09 | 0.095 | 10 | |
| | the rest | 0.09 | 0.09 | 0.09 | 0.09 | 0.09 | 0.09 | 15 | |
| | | 0.09 | 0.09 | 0.09 | 0.09 | 0.09 | 0.09 | 20 | |
| 2. | Magnesium 0.1 | 0.06 | 0.06 | 0.07 | 0.08 | 0.09 | 0.09 | 2 | 520 |
| | | 0.05 | 0.05 | 0.055 | 0.06 | 0.07 | 0.09 | 4 | |
| | Gallium | 0.04 | 0.04 | 0.045 | 0.05 | 0.055 | 0.09 | 10 | |
| | Aluminum- | 0.03 | 0.03 | 0.035 | 0.04 | 0.045 | 0.085 | 15 | |
| | the rest | 0.03 | 0.03 | 0.035 | 0.04 | 0.045 | 0.085 | 20 | |
| 3. | Magnesium 0.5 | 0.058 | 0.059 | 0.064 | 0.071 | 0.091 | 0.089 | 2 | 560 |
| | Gallium 2 | 0.052 | 0.052 | 0.057 | 0.062 | 0.072 | 0.087 | 4 | |
| | Aluminum- | 0.042 | 0.054 | 0.059 | 0.064 | 0.074 | 0.087 | 10 | |
| | the rest | 0.032 | 0.036 | 0.038 | 0.04 | 0.05 | 0.083 | 15 | |
| | | 0.032 | 0.036 | 0.038 | 0.04 | 0.05 | 0.083 | 20 | |
| 4. | Magnesium 1 | 0.04 | 0.04 | 0.05 | 0.055 | 0.08 | 0.086 | 2 | 570 |
| | Gallium 3.5 | 0.035 | 0.035 | 0.04 | 0.05 | 0.075 | 0.085 | 4 | |
| | Aluminum- | 0.033 | 0.033 | 0.034 | 0.035 | 0.075 | 0.085 | 10 | |
| | the rest | 0.031 | 0.031 | 0.033 | 0.036 | 0.074 | 0.084 | 15 | |
| | | 0.031 | 0.031 | 0.033 | 0.036 | 0.074 | 0.084 | 20 | |
| 5 | Magnesium 1.2 | 0.04 | 0.04 | 0.05 | 0.055 | 0.08 | 0.083 | 2 | 240 |
| | | 0.035 | 0.035 | 0.04 | 0.05 | 0.075 | 0.086 | 4 | |
| | Gallium 3.7 | 0.033 | 0.033 | 0.034 | 0.035 | 0.075 | 0.085 | 10 | |
| | | 0.031 | 0.031 | 0.033 | 0.036 | 0.074 | 0.084 | 15 | |
| | Aluminum- the rest | 0.031 | 0.031 | 0.033 | 0.036 | 0.074 | 0.084 | 20 | |

INDUSTRIAL APPLICABILITY

A compound for protecting the internal surface of a pipeline against corrosion finds application in land reclamation, technical, public and drinking water supply, as well as in power-and-heat supply and in pipelines designed to feed water to oil and gas wells and to supply sea water.

What we claim is:

1. A method of protecting the internal surface of a pipeline against corrosion comprising introducing into the pipeline 0.01 to 1.0 parts of a composition comprising:

(a) a phosphate selected from the group consisting of sodium polyphosphate and monosubstituted potassium phosphate, with (b) a silicate of an alkaline metal or silicon dioxide, in a weight ratio of (a) to (b) of about 9–50:1, respectively, and up to 100 parts of water; and wherein said composition is fused at a temperature of about 800 to 1000 degrees C. and cooled until a vitreous structure is formedl; and wherein said composition is introduced into a pipeline containing water having a $P_2O_5$ concentration of about 0.3 to 3.5 mg/l.

2. The method of claim 1, wherein the vitreous structure is treated with an electron beam having an energy of about $10^3$ to $10^5$ kW/cm$^2$.

3. The method of claim 1, wherein the concentration of $P_2O_5$ varies from about 0.3 to 0.6 mg/l.

4. The method of claim 1, wherein the composition is pressed in the internal surface of the water pipeline.

5. The method of claim 1, wherein the composition introduced in water moves along the internal surface of the pipeline, in the form of a layer adjacent to said surface.

6. The method of claim 5, wherein $P_2O_5$ has a concentration of about 0.3 to 0.6 mg/l.

7. The method of claim 1, wherein an aluminum alloy of the following composition and weight percent:

magnesium: 0.1–1.0 gallium: 0.1–3.5 aluminum: the remainder, is applied, prior to or alongside the introduction of said composition on the internal surface of the water pipeline.

* * * * *